US010828892B2

(12) United States Patent
Rivas et al.

(10) Patent No.: US 10,828,892 B2
(45) Date of Patent: Nov. 10, 2020

(54) PRINTHEAD WITH PRINTER FLUID CHECK VALVE

(71) Applicant: HEWLETT-PACKARD DEVELOPMENT COMPANY, L.P., Fort Collins, CO (US)

(72) Inventors: Rio Rivas, Corvallis, OR (US); Lawrence H White, Corvallis, OR (US); Ed Friesen, Corvallis, OR (US); Erik D Torniainen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 105 days.

(21) Appl. No.: 15/547,116

(22) PCT Filed: Apr. 27, 2015

(86) PCT No.: PCT/US2015/027824
§ 371 (c)(1),
(2) Date: Jul. 28, 2017

(87) PCT Pub. No.: WO2016/175746
PCT Pub. Date: Nov. 3, 2016

(65) Prior Publication Data
US 2018/0009222 A1 Jan. 11, 2018

(51) Int. Cl.
*B41J 2/14* (2006.01)
*B41J 2/16* (2006.01)

(52) U.S. Cl.
CPC ..... *B41J 2/14032* (2013.01); *B41J 2/1404* (2013.01); *B41J 2/14145* (2013.01);
(Continued)

(58) Field of Classification Search
CPC ..... B41J 2/17503; B41J 2/17563; B41J 2/17566; B41J 2/17593; B41J 2/17596; B41J 2/18
See application file for complete search history.

(56) References Cited

U.S. PATENT DOCUMENTS 5,847,734 A * 12/1998 Pawlowski, Jr. ..... B41J 2/1707 347/86
5,872,582 A 2/1999 Pan et al.
(Continued)

FOREIGN PATENT DOCUMENTS

CN 1149018 5/1997
CN 101052529 10/2007
(Continued)

OTHER PUBLICATIONS

Unknown, "Applications: Actuated Systems", CSE 495/595: Intro to Micro- and Nano-Embedded Systems, Retrieved on Nov. 15, 2017, 52 pages.
(Continued)

*Primary Examiner* — Kristal Feggins
(74) *Attorney, Agent, or Firm* — Rathe Lindenbaum LLP

(57) ABSTRACT

In some examples, a printhead can include a main printer fluid line, a firing chamber in fluid communication with the main printer fluid line to receive printer fluid from the main printer fluid line, and a resistor positioned in the firing chamber. The resistor can, for example, receive an electronic current to cause the resistor to heat up and eject printer fluid droplets from the printhead. The printhead can further include a photolithographically fabricated check valve positioned in the firing chamber. The check valve can, for example, be openable to allow filling of the firing chamber with printer fluid and closeable to at least partially seal the main printer fluid line from printer fluid blowback caused by the resistor.

20 Claims, 16 Drawing Sheets

(52) U.S. Cl.
CPC ..... *B41J 2/1601* (2013.01); *B41J 2/1631* (2013.01); *B41J 2202/05* (2013.01)

(56) References Cited

U.S. PATENT DOCUMENTS

| | | | | |
|---|---|---|---|---|
| 5,926,955 | A * | 7/1999 | Kober | F15C 5/00 251/61.1 |
| 6,183,067 | B1 | 2/2001 | Matta et al. | |
| 6,386,682 | B1 | 5/2002 | Kimura | |
| 8,043,517 | B2 | 10/2011 | Gu et al. | |
| 2001/0043255 | A1 | 11/2001 | Kubota et al. | |
| 2005/0264627 | A1 | 12/2005 | Kim | |
| 2006/0092236 | A1 | 5/2006 | Kwon et al. | |
| 2006/0214962 | A1 | 9/2006 | Takata | |
| 2007/0102458 | A1* | 5/2007 | Valley | B05B 9/01 222/334 |
| 2011/0316942 | A1 | 12/2011 | Koyama | |
| 2012/0081483 | A1 | 4/2012 | Price et al. | |
| 2012/0081484 | A1 | 4/2012 | Price et al. | |
| 2012/0200645 | A1* | 8/2012 | Okina | B41J 2/175 347/85 |
| 2013/0002775 | A1 | 1/2013 | Matsubara | |
| 2014/0210912 | A1 | 7/2014 | Cagle et al. | |

FOREIGN PATENT DOCUMENTS

| | | |
|---|---|---|
| CN | 103223775 | 7/2013 |
| EP | 0436047 | 7/1991 |
| EP | 0816088 | 1/1998 |
| JP | 2001225474 | 8/2001 |

OTHER PUBLICATIONS

Darren Hanna. "Applications: Actuated Systems", CSE 495/595: Intro to Micro- and Nano-Embedded Systems, Retrieved on Nov. 15, 2017, 52 pages.

* cited by examiner

PRINTHEAD WITH PRINTER FLUID CHECK VALVE

BACKGROUND

Inkjet printers can be used to print text, pictures, or other graphics by propelling droplets of printing fluid onto paper or other printer media. Such printers can include one or more printing fluid reservoirs to feed printer fluid to one or more printheads. Such reservoirs can contain different kinds of printing fluids, such as different colored printing fluids, so as to allow the printer to print in both monochrome as well as color graphics.

BRIEF DESCRIPTION OF THE DRAWINGS

For a detailed description of various examples, reference will now be made to the accompanying drawings in which.

NOTATION AND NOMENCLATURE

Figure 1:
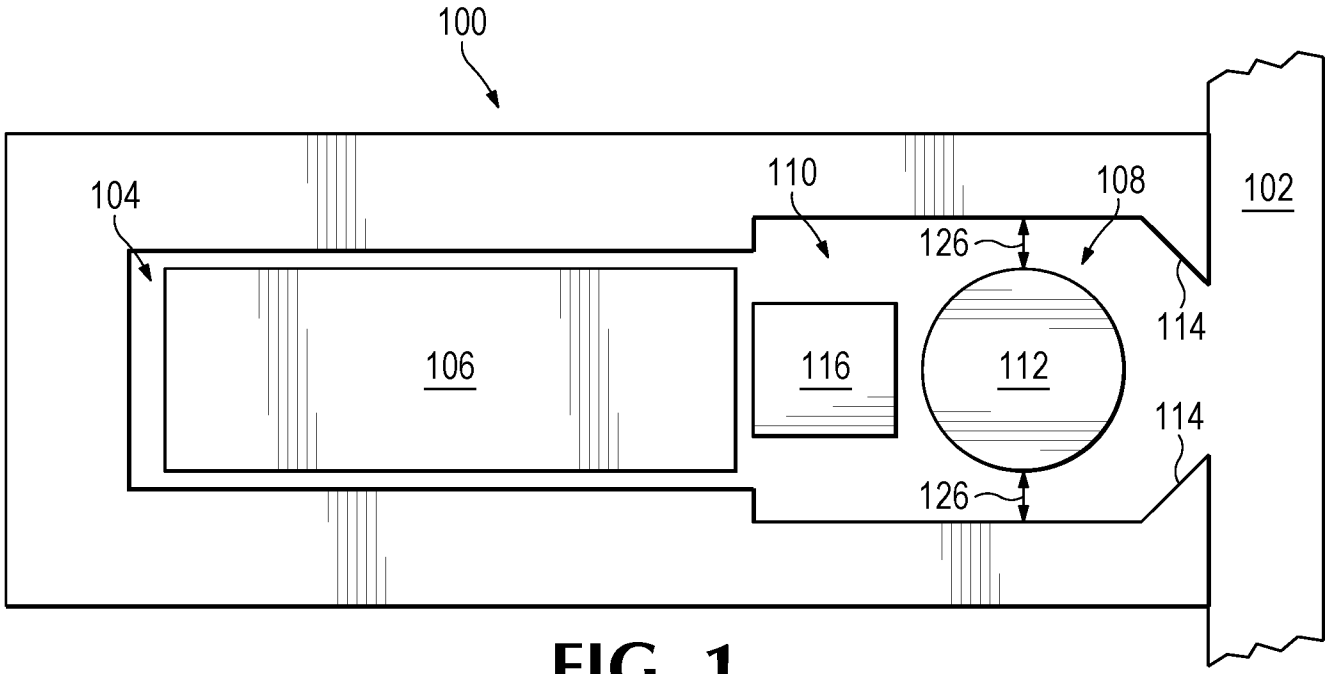
FIG. 1 is a top view of a portion of a printhead in an open state, according to an example.

In the following discussion and in the claims, the terms "including" and "comprising" are used in an open-ended fashion, and thus should be interpreted to mean "including, but not limited to . . . " The term "approximately" as used herein to modify a value is intended to be determined based on the understanding of one of ordinary skill in the art, and can, for example, mean plus or minus 10% of that value.

DETAILED DESCRIPTION

The following discussion is directed to various examples of the disclosure. Although one or more of these examples may be preferred, the examples disclosed should not be interpreted, or otherwise used, as limiting the scope of the disclosure, including the claims. In addition, the following description has broad application, and the discussion of any example is meant only to be descriptive of that example, and not intended to intimate that the scope of the disclosure, including the claims, is limited to that example.

Certain implementations of the present disclosure are directed to printheads including check valves that can eliminate and/or significantly reduce blowback of printer fluid generated by the firing of a resistor in the printhead to eject ink from the printhead. For example, in one implementation, such a printhead includes (1) a main printer fluid line, (2) a firing chamber in fluid communication with the main printer fluid line to receive printer fluid from the main printer fluid line, (3) a resistor positioned in the firing chamber, the resistor to receive an electronic current to cause the resistor to heat up and eject printer fluid droplets from the printhead, and (4) a photolithographically fabricated check valve positioned in the firing chamber. In such an implementation, the check valve can, for example, be openable to allow filling of the firing chamber with printer fluid and closeable to at least partially seal the main printer fluid line from printer fluid blowback caused by the resistor.

Certain implementations of the present disclosure can exhibit advantages compared to existing printheads. For example, in some implementations, the use of such a check valve can lead to improved thermal performance of the printhead. For example, thermal performance of a thermal inkjet (TIJ) device can be improved by eliminating and/or significantly reducing printer fluid blowback, which can reduce the amount of energy used for drop ejection. By lowering an amount of energy used for drop ejection, a printhead can be designed for use with a smaller resistor, which will lead to a corresponding reduction in thermal output. For example, in some implementations, the size of a resistor can be reduced by 50% compared to conventional resistors, which can lead to a 50% percent improvement in thermal output. Improved efficiency of the printhead due to the use of a check valve can reduce an operating temperature of the printhead and can thus reduce an amount of air that is out gassed. The out gassed air is a frequent failure mode for the printheads. In some implementations, a printhead can be run faster and keep the same temperature because a printer fluid droplets are ejected more efficiently. For certain implementations where the check valve is used with a piezo-electric inkjet (PIJ) printhead, the check valve can, for example, provide for acoustic damping during drop ejection. Other advantages of implementations presented herein will be apparent upon review of the description and figures.

Figure 2:
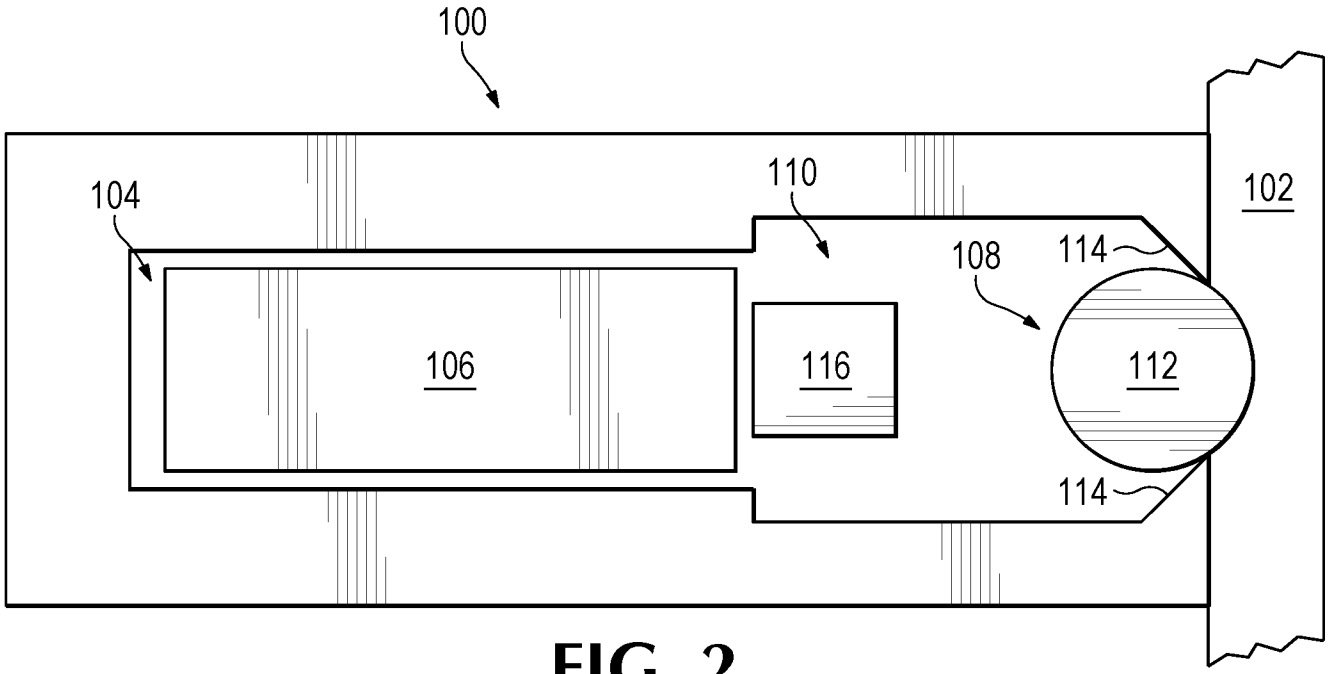
FIG. 2 is a top view of the portion of the printhead of FIG. 1 in a partially sealed, according to an example.

FIGS. 1 and 2 illustrates an example printhead 100. In this specific implementation, printhead 100 includes a main printer fluid line 102. Printhead 100 further includes a firing chamber 104 in fluid communication with main printer fluid line 102 to receive printer fluid from main printer fluid line 102. Printhead 100 further includes a resistor 106 positioned in firing chamber 104. Printhead 100 further includes a photolithographically fabricated check valve 108 positioned in firing chamber 104. Check valve 108 is openable to allow filling of firing chamber 104 with printer fluid and closeable to at least partially seal main printer fluid line 102 from printer fluid blowback caused by resistor 106. Further details regarding the various components and functionality of printhead 100 are provided below.

The term "photolithographically fabricated" as used herein can, for example, refer to suitable processes used in microfabrication of photoimageable materials to pattern parts of a thin film or the bulk of a substrate. An example photolithographic fabrication process is described below and illustrated with respect to FIGS. 5-15. Such a process can, for example, use light to transfer a geometric pattern from a photomask to a light-sensitive chemical "photoresist" on the substrate. A series of chemical treatments can then either engrave the exposure pattern into, or enable deposition of a new material in the desired pattern upon, the material underneath the photo resist.

Figure 16:
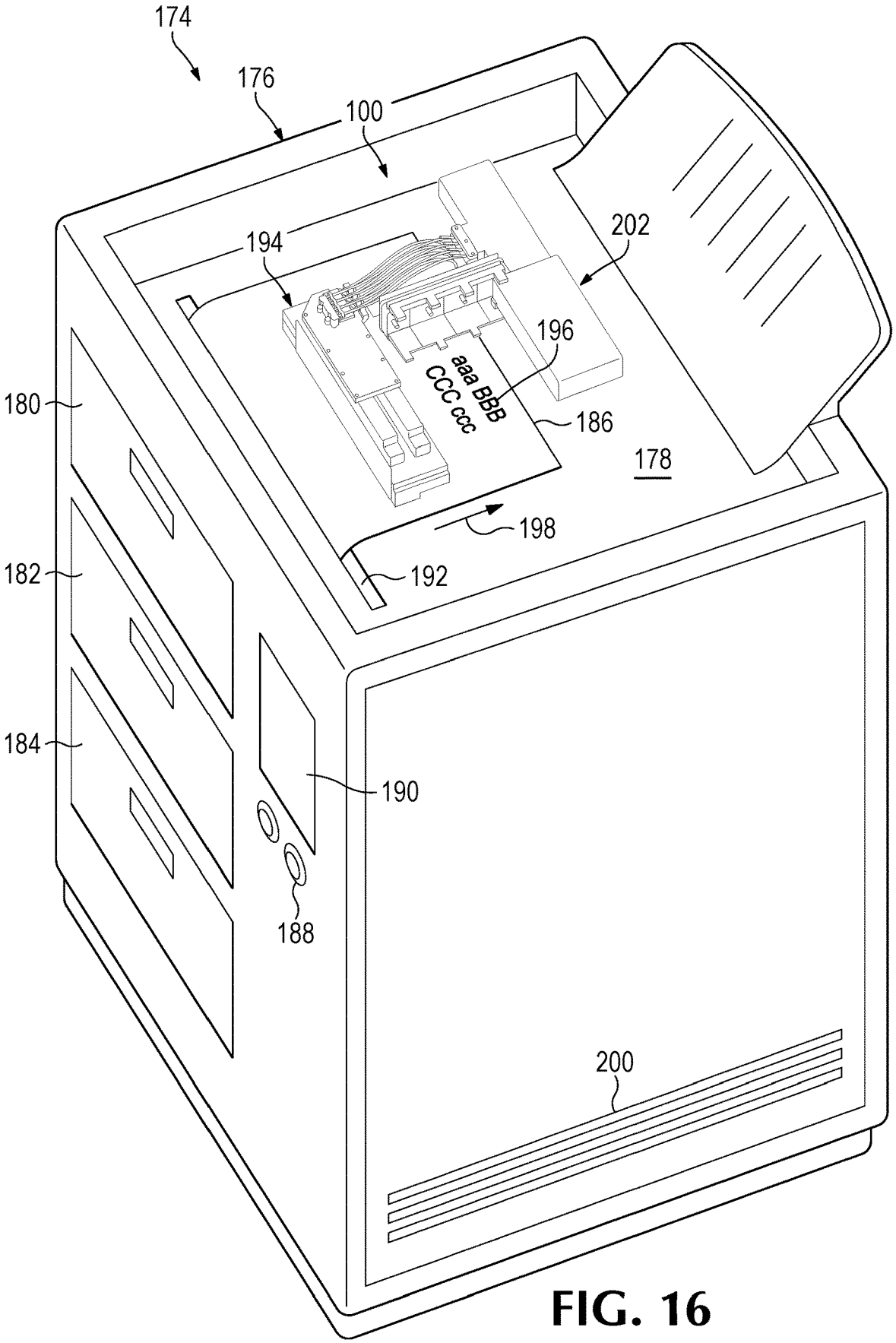
FIG. 16 is a diagram of a printer, according to an example.

The term "printer" as used herein can, for example, refer to both standalone printers as well as other machines capability of printing. For example, the term "printer" as used herein can refer to an all-in-one device that provides printing as well as non-printing functionality, such as a combination printer, 3D printer, scanner, and fax machine. One implementation of a suitable printer for use with the printhead described herein is shown in FIG. 16 and is described in further detail below. In addition, the term "print" can, for example, refer to any suitable technique, such as ejecting, spraying, propelling, depositing, or the like.

The term "inkjet printer" as used herein is used for convenience and is not intended to refer to only ink-based printers. That is, the term "inkjet printer" can for example refer to a printer that prints any suitable printer fluid. The term "printer fluid" as used herein can, for example, refer to printer ink as well as suitable non-ink fluids. For example, printer fluid can include a pre-conditioner, gloss, a curing agent, colored inks, grey ink, black ink, metallic ink, optimizers and the like. Suitable inks for use in inkjet printers can, for example, be water based inks, latex inks or the like. In some implementations, printer fluid can be in the form of aqueous or solvent printing fluid and can be any suitable color, such as black, cyan, magenta, yellow, etc. In some implementations, printhead 100 can be in the form of a thermal inkjet (TIJ) printhead and resistor 106 is used to heat the printer fluid to eject printer fluid droplets from printhead 100. In some implementations, printhead 100 is in the form of a piezo-electric inkjet (PIJ) printhead and resistor 106 is used to actuate an actuator to eject printer fluid droplets from printhead 100.

The term "printer media" as used herein can, for example, refer to any form of media onto which a printhead (e.g., printhead 100) can print. For example, printer media can be in the form of computer paper, photographic paper, a paper envelope, or similar paper media. Such printer media can be a standard rectangular paper size, such as letter, A4 or 11×17. It is appreciated that printer media can in some implementations be in the form of suitable non-rectangular and/or non-paper media, such as clothing, wood, or other suitable materials. For example, in some implementations, the term "printer media" as used herein can refer to a bed of build material for use in three-dimensional (3D) printing.

As provided above, printhead 100 includes main printer fluid line 102, which is in fluid communication with firing chamber 104 to provide printer fluid to firing chamber 104 (by way of a check valve chamber as described below). The term "main printer fluid line" can refer generally to any suitable printer fluid channel in printhead 100 that connects firing chamber 104 to a printer fluid reservoir or other source of printer fluid. For example, in some implementations, main printer fluid line 102 can be in the form of an ink slot or inkfeed slot. Main printer fluid line 102 can be photolithographically fabricated using a similar operation to one or more other components of printhead 100 or can be fabricate using a different suitable technique, such as machining.

As provided above, firing chamber 104 houses resistor 106 and is to receive printer fluid from main printer fluid line 102. As described in further detail with respect to the method of FIG. 5, firing chamber 104 can be photolithographically fabricated along with other components of printhead 100. Resistor 106 can, for example, be substantially flat and rectangular, or another suitable shape based on the dimensions or shape of other components of printhead 100.

Resistor 106 can be designed to print printing fluid onto printer media. In certain implementations of printhead 100 resistor 106 is to receive an electronic current to cause resistor 106 to heat up and eject printer fluid droplets from printhead 100. For example, printhead 100 can, for example, be designed to print via a TIJ process using resistor 106. In certain TIJ processes, resistor 105 can be used to eject fluid droplets from printhead 100 via a pulse of current that is passed through resistor 106. Heat from the current passing through resistor 106 can, for example, cause a rapid vaporization of printing fluid in printhead 100 to form a bubble, which can, for example, cause a large pressure increase that propels a droplet of printing fluid onto the printer media. As another example, printhead 100 can be designed to print via a piezoelectric inkjet process using resistor 106. In certain piezoelectric inkjet processes, a voltage can be applied to resistor 106 in the form of a piezoelectric material located in a printing fluid-filled chamber. When a voltage is applied, the piezoelectric material changes shape, which generates a pressure pulse that forces a droplet of printing fluid from the printhead onto printer the media. It is appreciated that other forms of resistors can be used in accordance with the present disclosure.

Check valve 108 can refer to a valve formed by a check valve chamber 110, check valve element 112 (i.e., a movable element, such as for example a cylinder or poppet, that is used to open or close the opening between check valve chamber 110 and main printer fluid line 102) movably disposed within check valve chamber 110, a check valve seat 114 designed to restrict movement of check valve element 112 while allowing check valve element 112 to create at least a partial seal of main printer fluid line 102.

Figure 3:
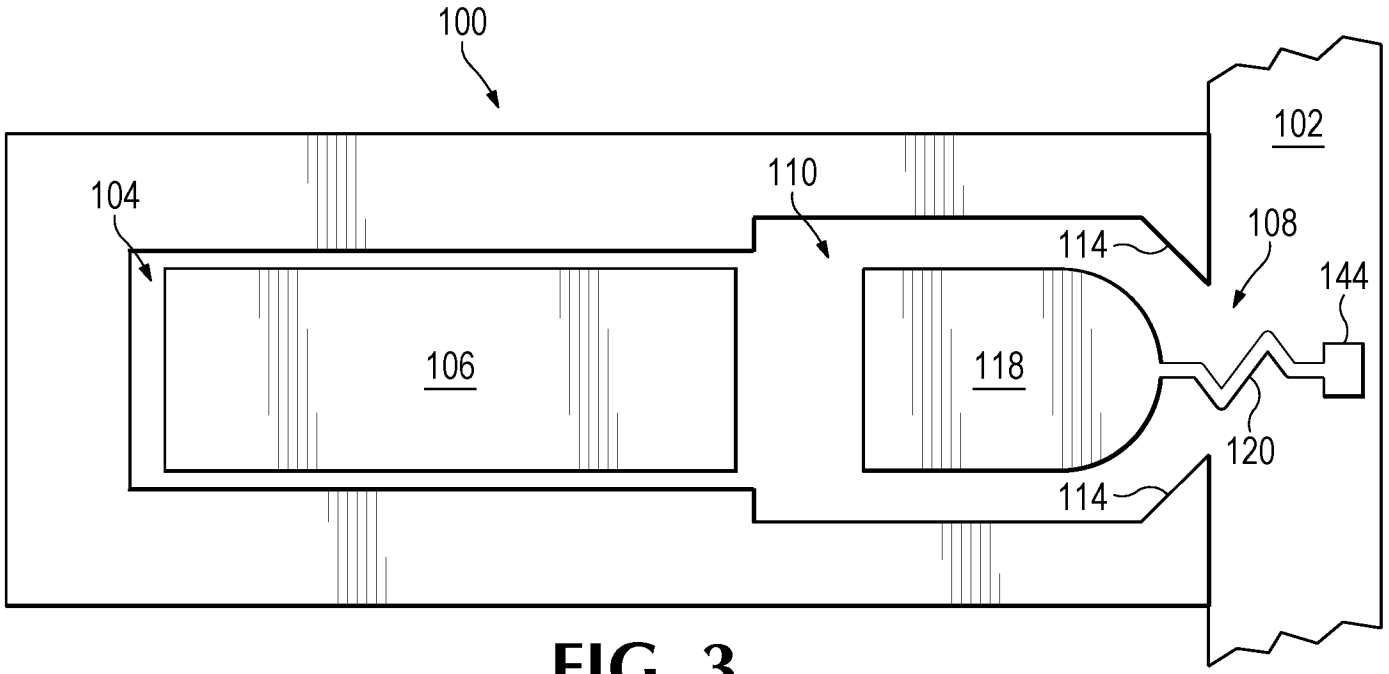
FIG. 3 is a top view of a portion of a printhead in an open state, according to another example.

As provided above, check valve 108 is openable to allow filling of firing chamber 104 with printer fluid and closeable to at least partially seal main printer fluid line 102 from printer fluid blowback caused by resistor 106. For example, in some implementations, check valve 108 is movable within firing chamber 104 to reduce printer fluid blowback caused by resistor 106. During refilling of firing chamber 104, a portion of check valve 108 or the entirety of check valve 108 can be moved to create an opening to allow printer fluid to fill firing chamber 104. In some implementations, such as the implementation illustrated in FIG. 1, check valve 108 can include a block 116 is located within check valve chamber 110 or another suitable location and is designed to prevent check valve element 112 from obstructing the path between check valve chamber 110 and firing chamber 104 when check valve 108 is in an open state. It is appreciated that in other implementations, such as that illustrated in FIG. 3, block 116 may not be used.

In some implementations, check valve 108 is to at least partially seal main printer fluid line 102 but allow some printer fluid to enter main printer fluid line 102 from firing chamber 104. The amount of printer fluid that is able to enter main printer fluid line 102 due to the at least partial seal can be designed to allow for an acceptable pressure to build in firing chamber 104 without damaging firing chamber 104. It is appreciated that the term "at least partially seal" (and its variants) as used herein can, in some implementations, include substantially complete seals that substantially prevent any printer fluid from entering main printer fluid line 102 from firing chamber 104. In some implementations where a substantially complete seal is provided by check valve 108, printhead 100 can be designed to reduce pressure within firing chamber 104 using a valve or another pressure-releasing structure. In some implementations where a substantially complete seal is provided by check valve 108, printhead 100 may not include any additional pressure-releasing structure and can, for example, be designed to withstanding blowback pressure from resistor 106. Changes in dimensions of components of printhead 100, such as for example the size of gaps between check valve 108 and the check valve chamber 110, can be used to adjust the amount of printer fluid that is able to enter main printer fluid line 102 from firing chamber 104 when check valve is closed to at least partially seal main printer fluid line 102.

Figure 11A:
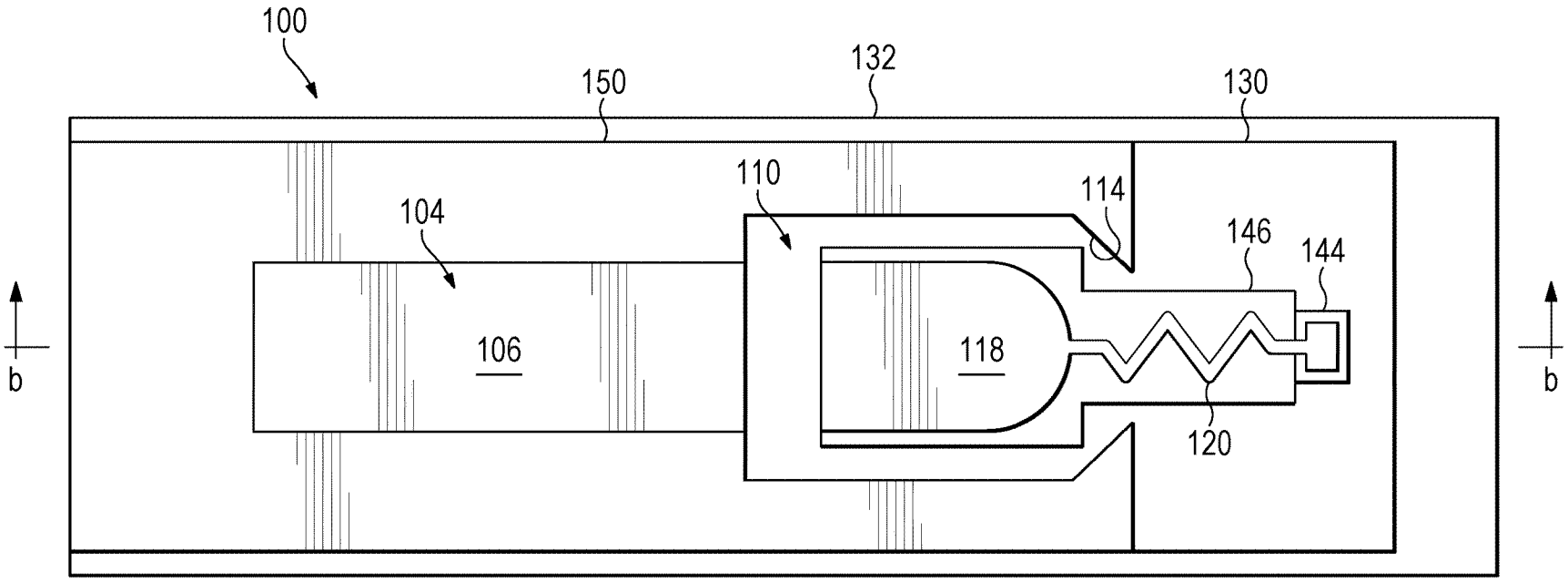
FIG. 11*a* is a top view of a portion of a printhead during fabrication of the printhead, according to the example fabrication method.
Figure 11B:
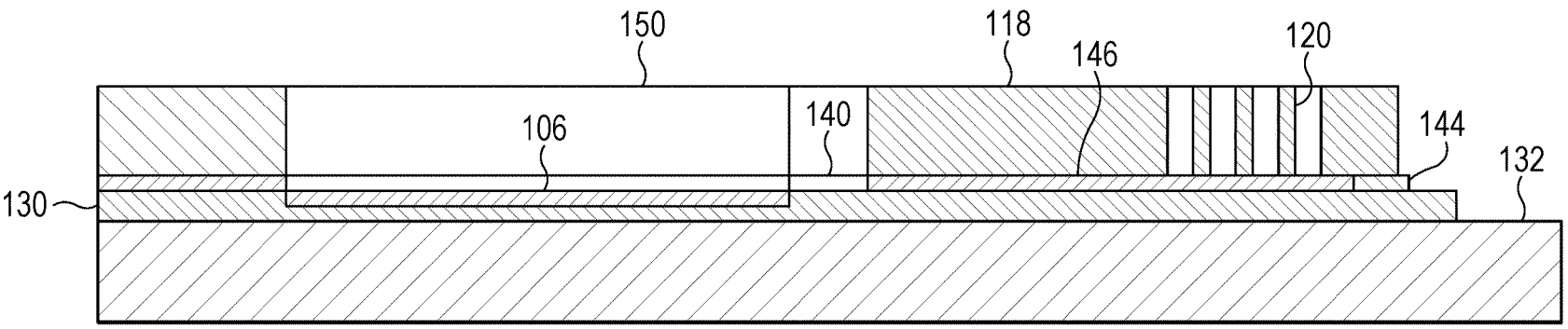
FIG. 11*b* is a cross-sectional view of the portion of the printhead of FIG. 11*a*.

As illustrated in FIG. 1, check valve 108 can, in some implementations, be in the form of a cylindrical valve that is slidable within the firing chamber. The term "slidable" is intended to include translational movement and/or rolling of check valve 108 within check valve chamber 110. In some implementations, such as that illustrated in FIG. 3, check valve 108 includes a check valve element 112 in the form of a head portion 118 and a spring portion 120 connected to a spring mount 144 of printhead 100. As shown by FIG. 11*b*, head portion 118 and spring portion 120 may be formed from a single layer photolithographically deposited on top of (indirectly on) the surface of the larger chamber formed by chambers 104 and 110. Head portion 118 can, for example, be used to at least partially seal main printer fluid line 102 and spring portion 120 can, for example, be used to bias head portion 118 to fully open a fluid path between main printer fluid line 102 and firing chamber 104. In other implementations, spring portion 120 can, for example, be used to bias head portion 118 to at least partially close a fluid path between main printer fluid line 102 and firing chamber 104. Head portion 118 and spring portion 120 can, for example, be a single piece of photolithographically fabricated material or can be separately manufactured and subsequently joined together.

Figure 4:
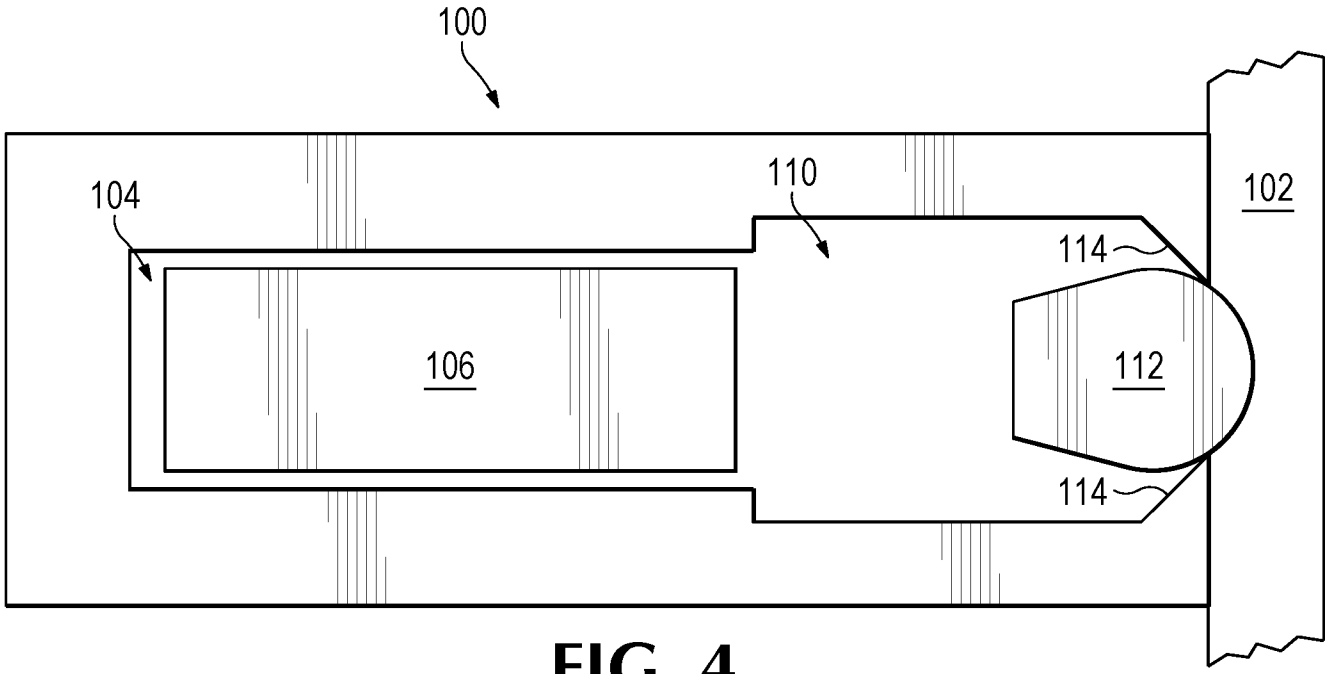
FIG. 4 is a top view of a portion of a printhead in a partially sealed state, according to another example.

In some implementations, such as that illustrated in FIG. 4, check valve element 112 is in the form of a non-circular or other non-geometric shape used to at least partially seal main printer fluid line 102 from check valve chamber 110. It is appreciated that other suitable shapes of check valve element 112 may be used. For illustration, the implementations of printheads 100 in FIGS. 3 and 4 use similar reference numbers as the implementation of printhead 100 in FIGS. 1 and 2. However, it is appreciated that different implementations may include the same components as other implementations, or may include fewer, additional, or different components. For example, the implementation of printhead 100 in FIG. 3 includes a spring portion 120, whereas the implementations of printhead 100 in FIGS. 1, 2, and 4 do not include such a spring portion. However, in some implementations, printheads 100 of FIGS. 1, 2, and 4 may include a spring portion attached to check valve element 112.

As described above, check valve 108 can be used to reduce an amount of energy used for drop ejection. For example, the use of check valve 108 can, for example, allow for a decreased resistor size used to obtain a desired drop weight and drop velocity, which can improve thermal efficiency. For example, a resistor size may be reduced from 460 um^2 for a printhead without a check valve to 330 um^2 for a printhead 100 with a check valve yet the momentum can be the same for a 9 ng drop ejection.

Figure 5:
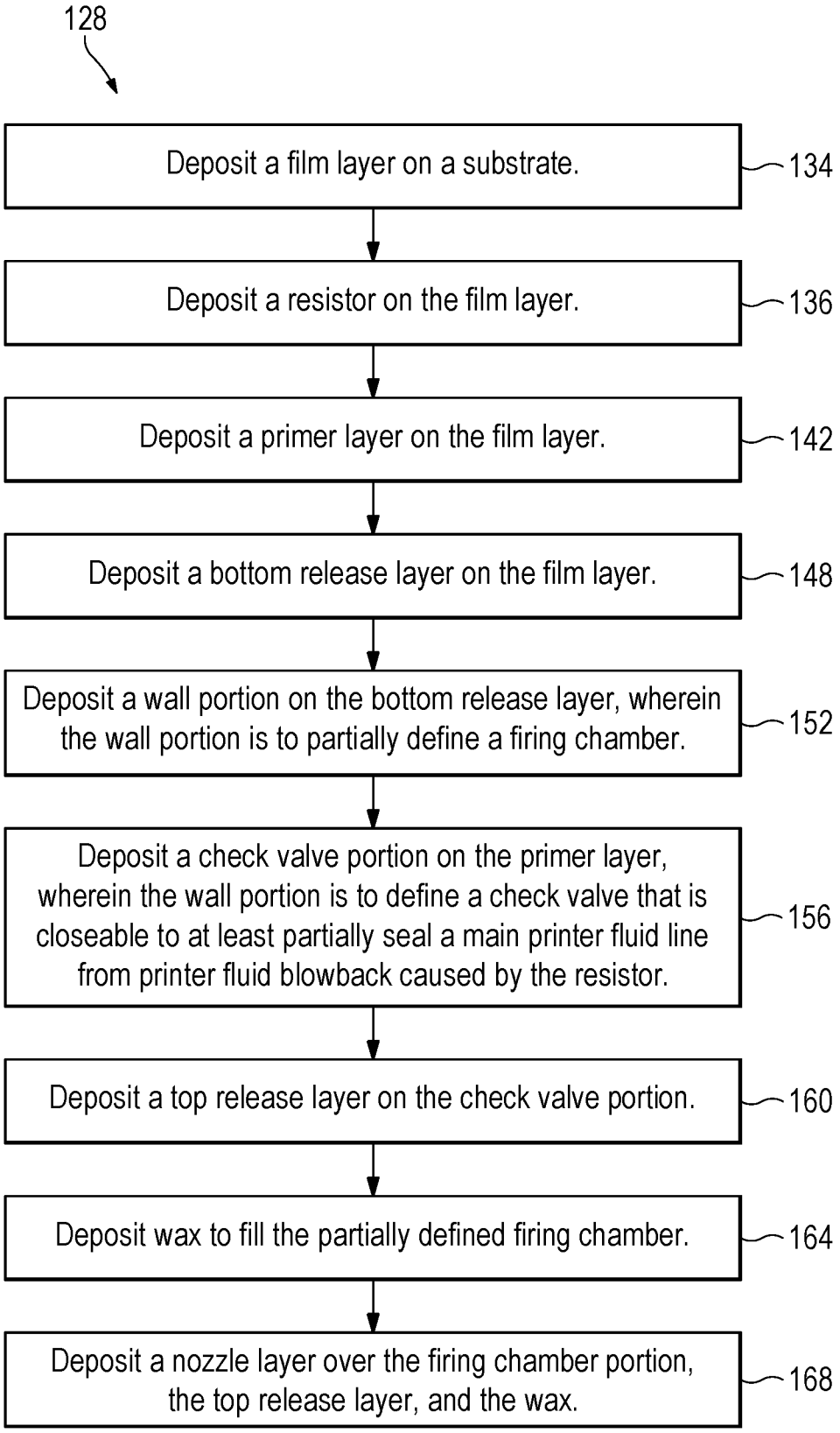
FIG. 5 is a flowchart illustrating a method, according to an example.

In the implementation of printhead 100 illustrated in FIGS. 1 and 5, printhead 100 includes various gaps 122, 124, and 126 between components of printhead 100 so as to allow check valve 108 to move relative to check valve chamber 110 and so as to allow check valve 108 to at least partially seal check valve chamber 110 from main printer fluid line 102. For example, printhead 100 includes a first photolithographically fabricated gap 122 (shown, for example, in FIG. 15*b*) between a bottom surface of check valve 108 and firing chamber 104, a second photolithographically fabricated gap 124 (shown, for example, in FIG. 15*b*) between a top surface of check valve 108 and firing chamber 104, and a third photolithographically fabricated gap 126 (or gaps) between a peripheral surface of the check valve and the firing chamber.

FIG. 5 illustrates a flowchart for an example method 128 relating to photolithographically fabricating a printhead and FIGS. 6-15 illustrate various steps of method 128. The description of method 128 and its component blocks make reference to elements of printhead 100 for illustration, however, it is appreciated that this method can be used for any suitable printhead or other implementation described herein or otherwise.

Figure 6A:
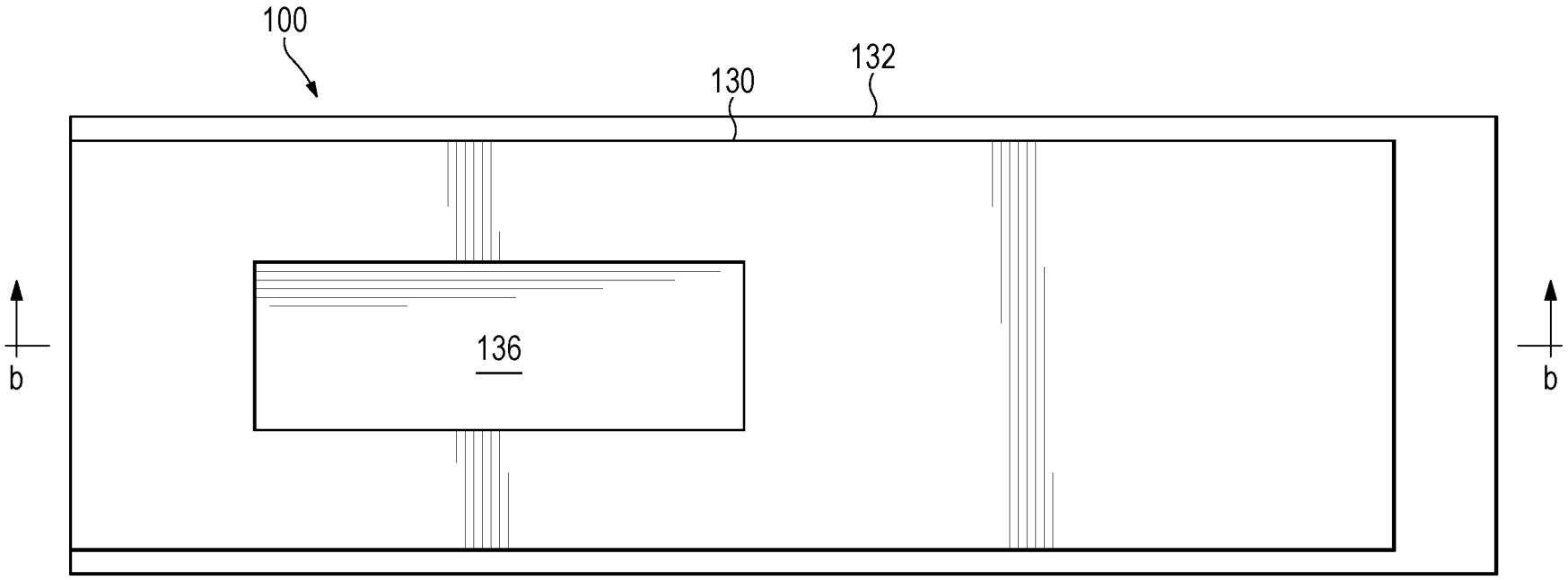
FIG. 6*a* is a top view of a portion of a printhead during fabrication of the printhead, according to an example fabrication method.
Figure 6B:
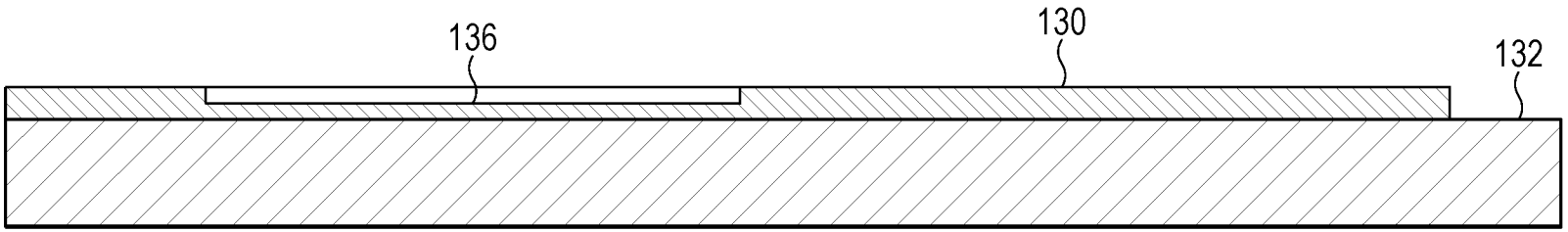
FIG. 6*b* is a cross-sectional view of the portion of the printhead of FIG. 6*a*.

The implementation of method 128 of FIG. 5 includes depositing a film layer 130 on a substrate 132 (block 134). FIG. 6*a* is a top view diagram depicting an example film layer 130 deposited on substrate 132 and FIG. 6*b* is a cross-sectional view diagram of FIG. 6*a* along line b-b. Film layer 130 can be deposited on substrate 132 to include a resistor cavity 136 dimensioned to securely receive resistor 106. Substrate 132 can, for example, be in the form of a silicon block or plate. Film layer 130 can be made of a material for insulating one or more sides of resistor 106. For example, in some implementations, film layer 130 is made of a material to thermally and electrically insulate resistor 106 so as to suitable isolate heat or electrical current of resistor 106 during operation of printhead 100. Film layer 130 can be deposited on substrate 132 via a photolithographic technique or through another suitable fabrication technique.

Figure 7A:
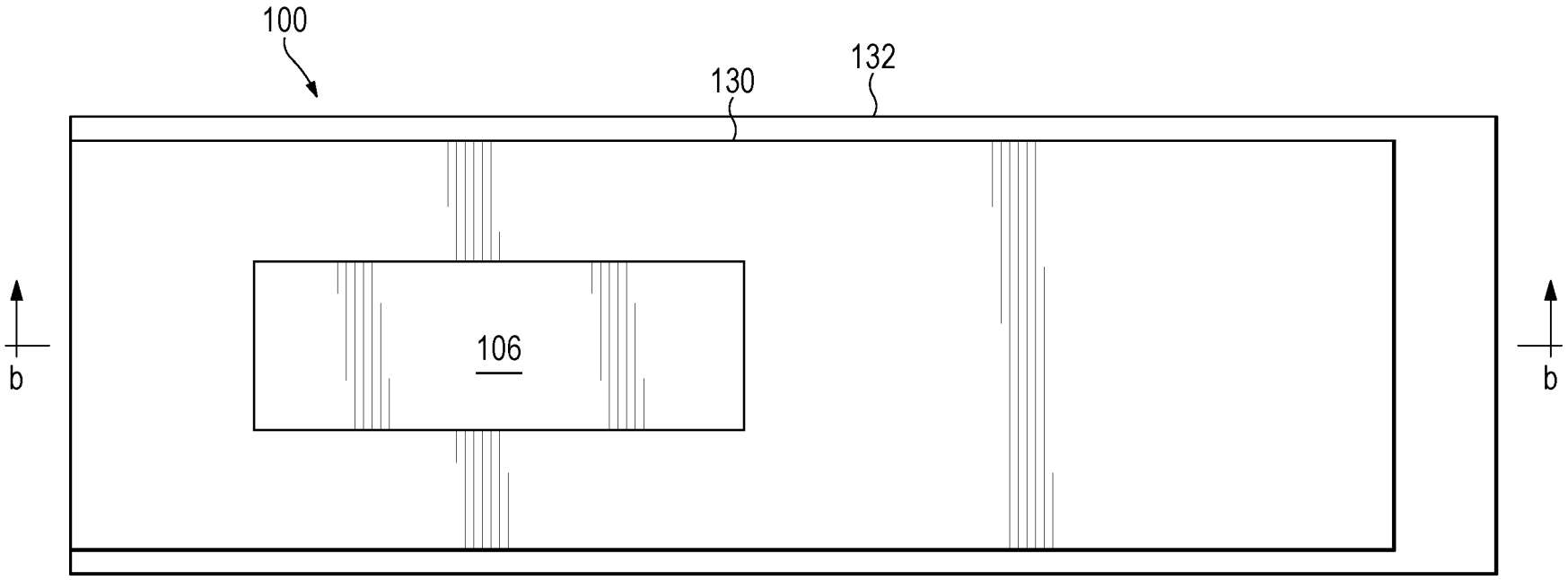
FIG. 7*a* is a top view of a portion of a printhead during fabrication of the printhead, according to the example fabrication method.
Figure 7B:
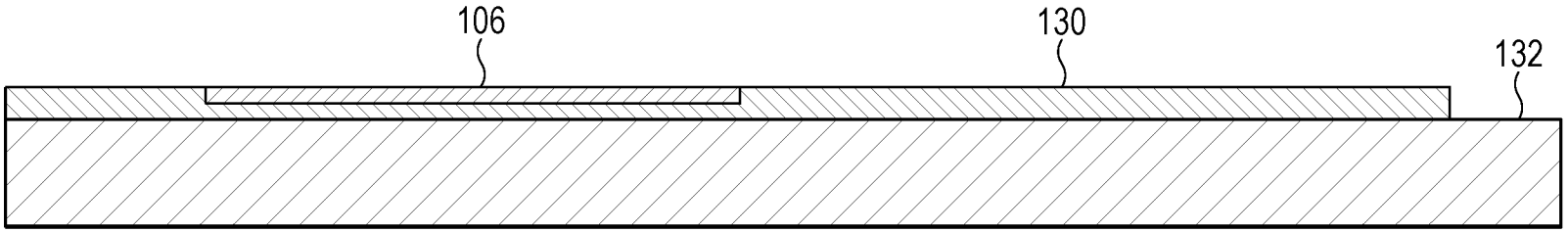
FIG. 7*b* is a cross-sectional view of the portion of the printhead of FIG. 7*a*.

The implementation of method 128 of FIG. 5 includes depositing a resistor 106 on film layer 130 (block 136), FIG. 7a is a top view diagram depicting an example resistor 106 deposited within resistor cavity 136 formed in substrate 132 and FIG. 7b is a cross-sectional view diagram of FIG. 7a along line b-b. As illustrated in FIGS. 7a and 7b, resistor 106 can fit snugly within resistor cavity 136 so as to secure resistor 106 within resistor cavity 136. In some implementations, resistor cavity 136 includes one or more gaps surrounding resistor 106 or other configurations. In some implementations, film layer 130 does not include a resistor cavity 136 and resistor is secured to film layer 130 or substrate 132 through another structure or arrangement. For example, in some implementations, resistor 106 is secured to film layer 130 or substrate 132 through the use of adhesives or screws. Resistor 106 can be connected to a power source to supply current to resistor 106 via electrical leads or another suitable wired or wireless electrical connection. In some implementations, resistor 106 can be deposited into resistor cavity 136 by placing a pre-formed resistor 106 into resistor cavity 136. In some implementations, resistor 106 can be photolithographically deposited in resistor cavity 136 or placed in resistor cavity 136 using another suitable fabrication technique.

Figure 8A:
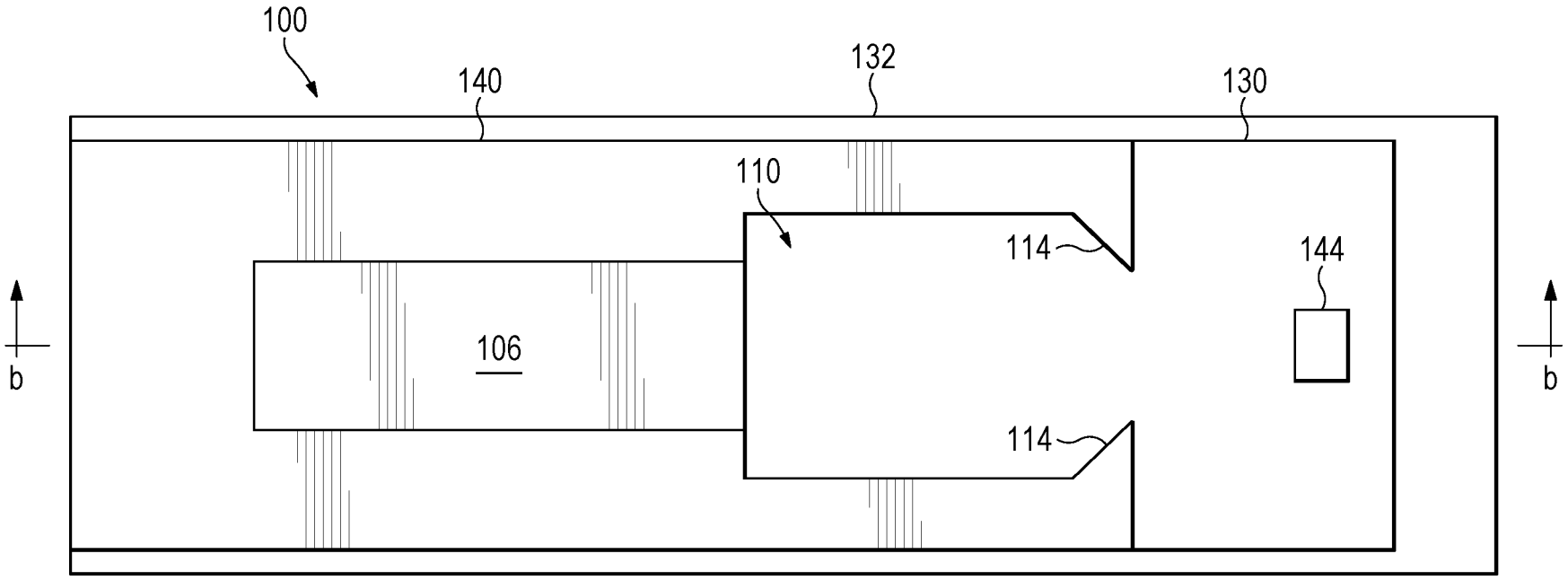
FIG. 8*a* is a top view of a portion of a printhead during fabrication of the printhead, according to the example fabrication method.
Figure 8B:
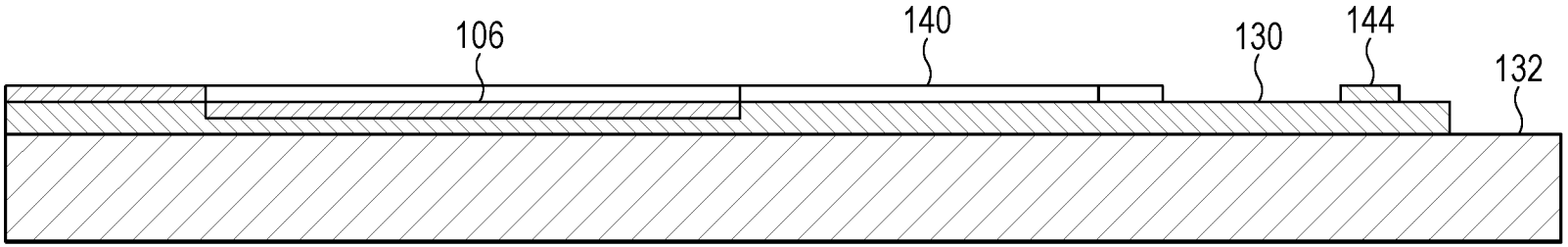
FIG. 8*b* is a cross-sectional view of the portion of the printhead of FIG. 8*a*.

The implementation of method 128 of FIG. 5 includes depositing a primer layer 140 on film layer 130 (block 142). FIG. 8a is a top view diagram depicting an example primer layer 140 deposited on film layer 130 and FIG. 8b is a cross-sectional view diagram of FIG. 8a along line b-b. Primer layer 140 can be used to provide structural support for various fixed structural elements of printhead 100, such as firing chamber 104, spring mount 144, check valve 108, check valve chamber 110, and check valve seat 114. Primer layer 140 can be deposited on substrate 132 via a photolithographic technique or through another suitable fabrication technique.

Figure 9A:
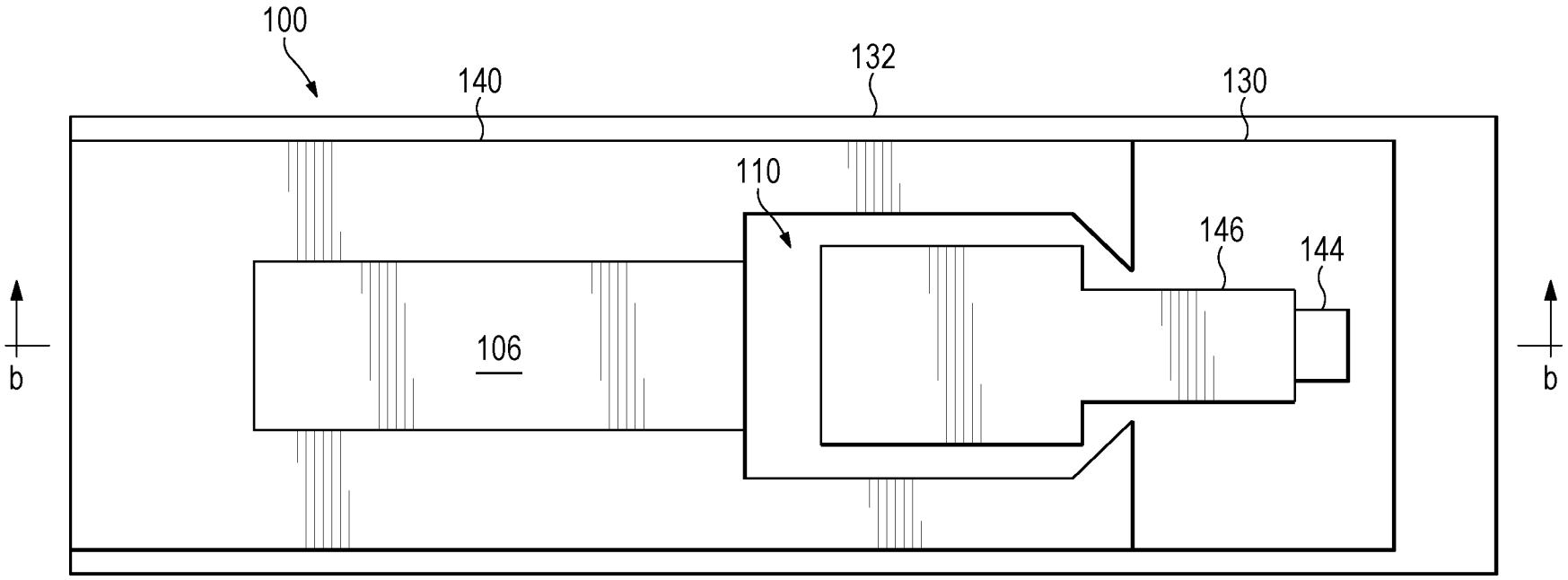
FIG. 9*a* is a top view of a portion of a printhead during fabrication of the printhead, according to the example fabrication method.
Figure 9B:
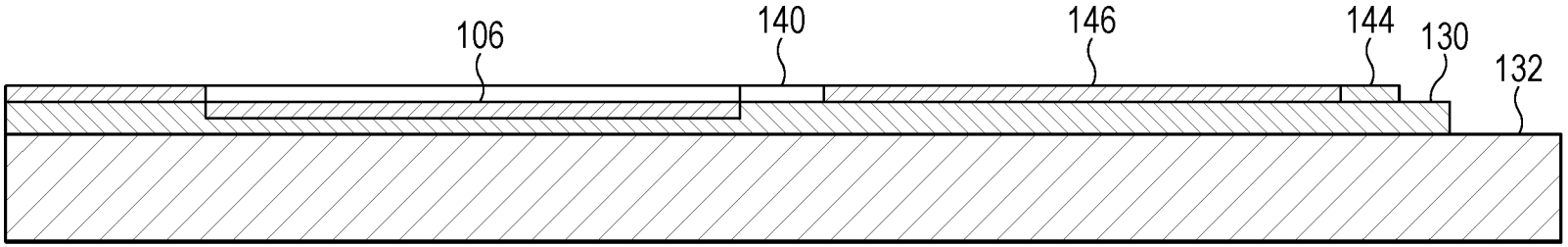
FIG. 9*b* is a cross-sectional view of the portion of the printhead of FIG. 9*a*.
Figure 12A:
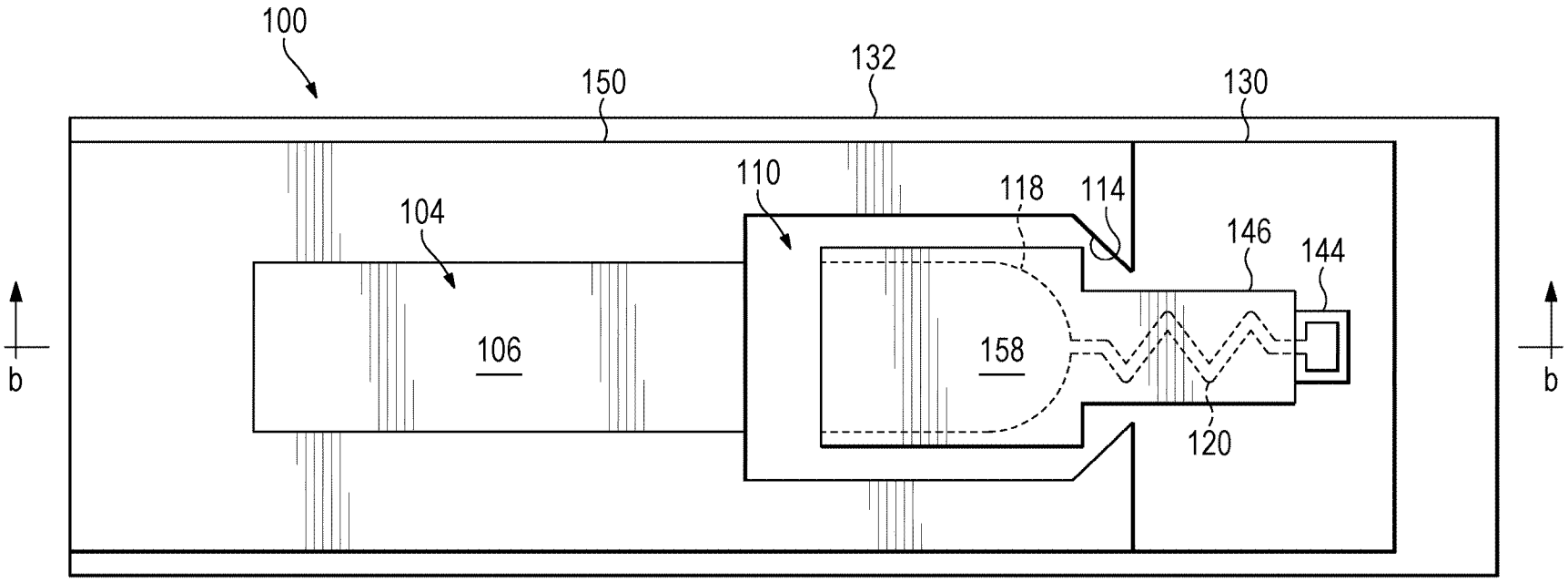
FIG. 12*a* is a top view of a portion of a printhead during fabrication of the printhead, according to the example fabrication method.
Figure 12B:
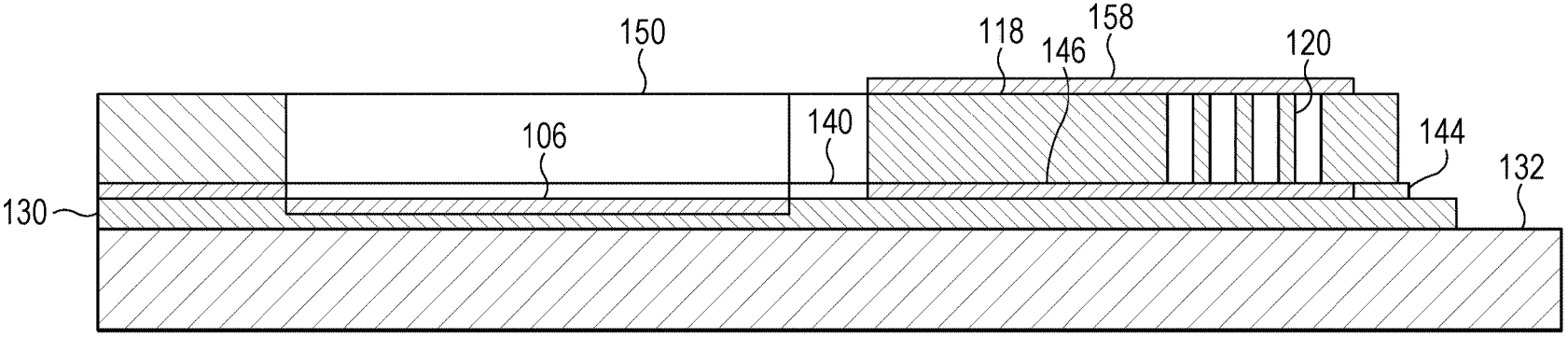
FIG. 12*b* is a cross-sectional view of the portion of the printhead of FIG. 12*a*.

The implementation of method 128 of FIG. 5 includes depositing a bottom release layer 146 on film layer 130 (block 148). FIG. 9a is a top view diagram depicting an example bottom release layer 146 deposited on film layer 130 and FIG. 9b is a cross-sectional view diagram of FIG. 9a along line b-b. Bottom release layer 146 is designed to allow movable parts of printhead 100, such as check valve element 112 to be fabricated using photolithographic techniques. As such, bottom release layer 146 can track a footprint of check valve element 112. Bottom release layer 146 illustrated in FIG. 9a serves as a support layer and roughly tracks the general footprint of check valve element 112 (see FIG. 11a). In some implementations, bottom release layer 146 can substantially track the exact footprint of check valve element 112. As shown by FIG. 12b, release layer 146 extends from check valve head portion 118 and spring portion 120, serving as a support layer for both. In the example illustrated, check valve head portion 118 and spring portion 120 are formed photolithographically on the surface of chamber 110 and are affixed to chamber 110 by release layer 146 prior to subsequent release. As a result, prior to such release, check valve head portion 118 is affixed to chamber 110 against movement relative to chamber 110. Bottom release layer 146 and other release layers described herein can be made of aluminum or other materials that can be easily removed during a release removal process. Bottom release layer 146 can be deposited on substrate 132 via a photolithographic technique or through another suitable fabrication technique.

Figure 10A:
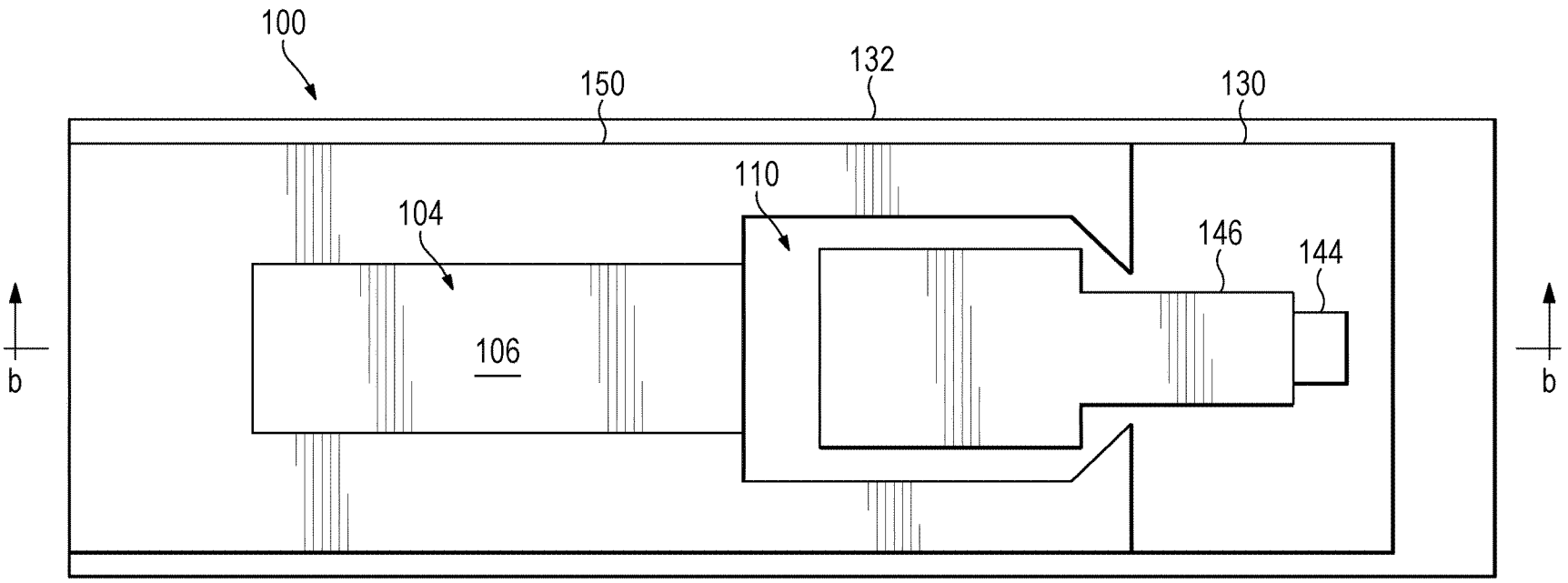
FIG. 10*a* is a top view of a portion of a printhead during fabrication of the printhead, according to the example fabrication method.
Figure 10B:
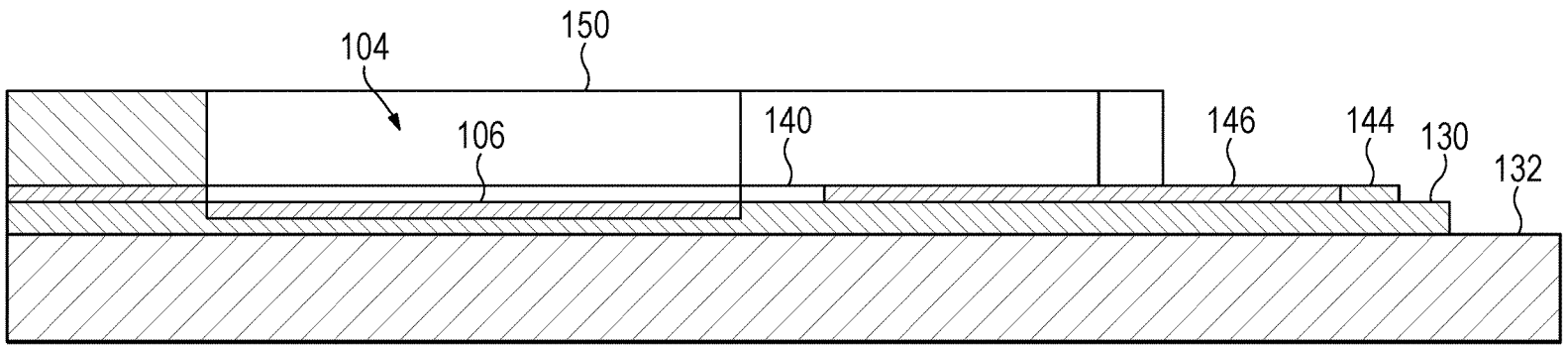
FIG. 10*b* is a cross-sectional view of the portion of the printhead of FIG. 10*a*.

The implementation of method 128 of FIG. 5 includes depositing a wall portion 150 on bottom release layer 146 (block 152). FIG. 10a is a top view diagram depicting an example wall portion 150 deposited on primer layer 140 and FIG. 10b is a cross-sectional view diagram of FIG. 10a along line b-b. Wall portion 150 can, for example, be used to partially define various fixed structural elements of printhead 100, such as firing chamber 104, check valve chamber 110, and check valve seat 114. Wall portion 150 can be deposited on substrate 132 via a photolithographic technique or through another suitable fabrication technique.

The implementation of method 128 of FIG. 5 includes depositing a check valve 108 on bottom release layer 146 and spring mount 144 (block 156). FIG. 11a is a top view diagram depicting an example check valve 108 deposited on primer layer 140 and FIG. 11b is a cross-sectional view diagram of FIG. 11a along line b-b. Check valve 108, as well as other elements of printhead 100 can, for example, be fabricated from a suitable photolithographic material, such as for example SU8. As provided above, check valve 108 is to define a check valve 108 that is closeable to at least partially seal a main printer fluid line 102 from printer fluid blowback caused by resistor 106. In some implementations, block 152 and block 156 are performed in a single photolithographic operation. In some implementations block 152 and block 156 include depositing wall portion 150 and check valve 108 to have the same height. In other implementations, block 152 and block 156 include depositing wall portion 150 and check valve 108 to have different heights. Check valve 108 can be deposited on substrate 132 via a photolithographic technique or through another suitable fabrication technique.

The implementation of method 128 of FIG. 5 includes depositing a top release layer 158 on check valve 108 (block 160). FIG. 12a is a top view diagram depicting an example top release layer 158 deposited on check valve 108 and FIG. 12b is a cross-sectional view diagram of FIG. 12a along line b-b. Similar to bottom release layer 146 described above, top release layer 158 is designed to allow movable parts of printhead 100, such as check valve element 118 to be fabricated using photolithographic techniques. As such, top release layer 158 can also track a footprint of check valve element 112. Top release layer 158 illustrated in FIG. 12a roughly tracks the general footprint of check valve element 118 (see FIG. 11a). In some implementations, top release layer 158 can substantially track the exact footprint of check valve element 112. Top release layer 158 and other release layers described herein can be made of aluminum or other materials that can be easily removed during a release recovery process. Top release layer 158 can be deposited on substrate 132 via a photolithographic technique or through another suitable fabrication technique.

Figure 13A:
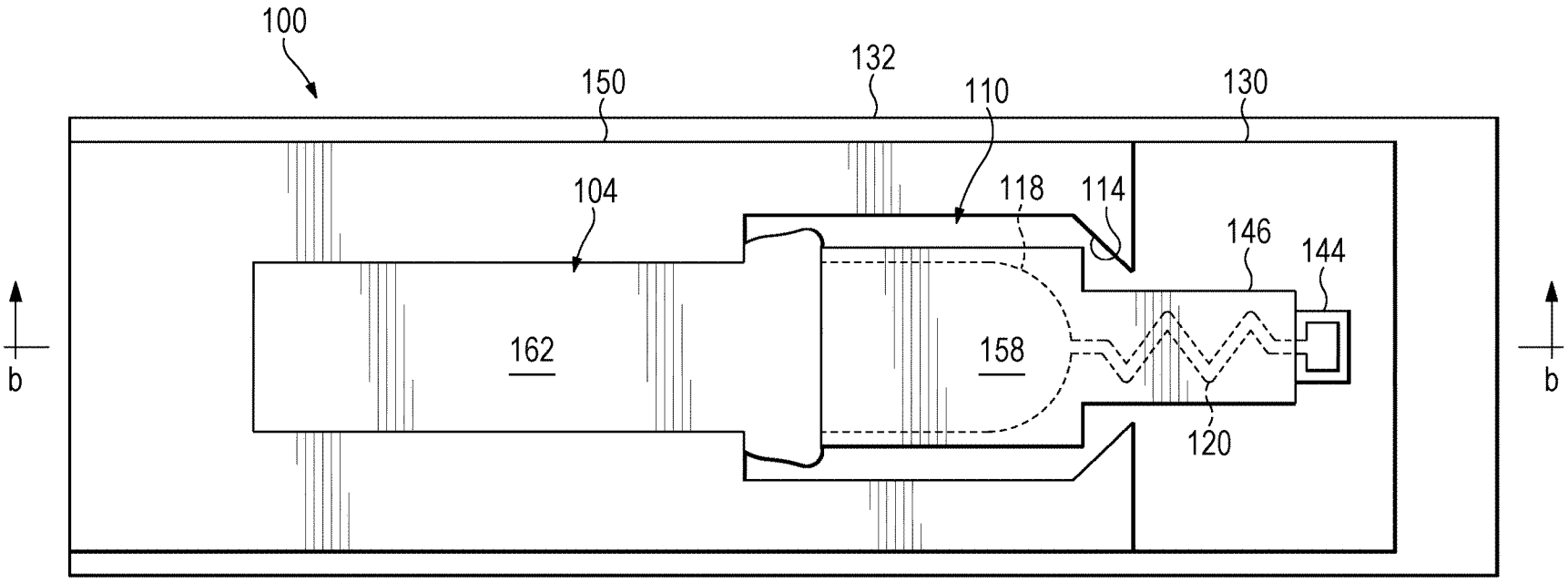
FIG. 13*a* is a top view of a portion of a printhead during fabrication of the printhead, according to the example fabrication method.
Figure 13B:
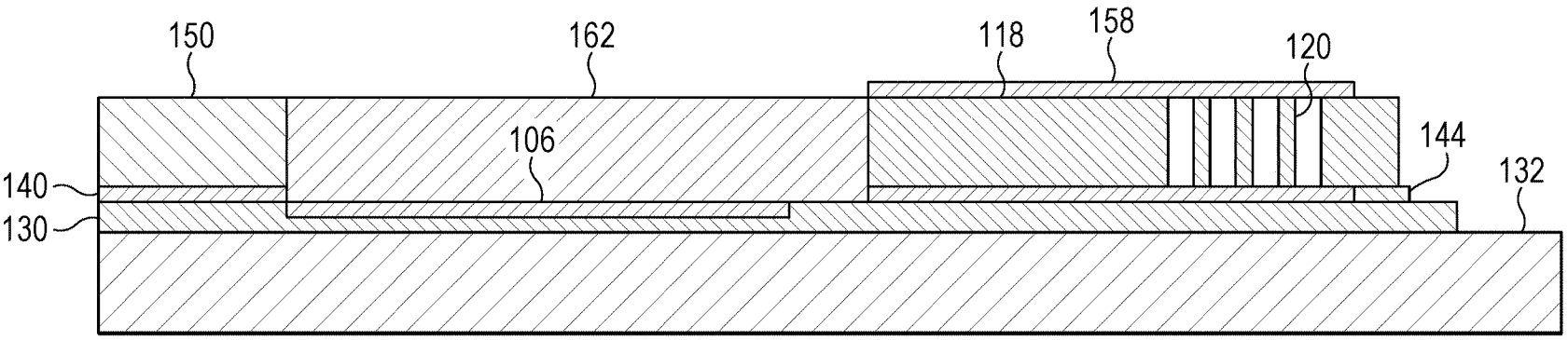
FIG. 13*b* is a cross-sectional view of the portion of the printhead of FIG. 13*a*.
Figure 14A:
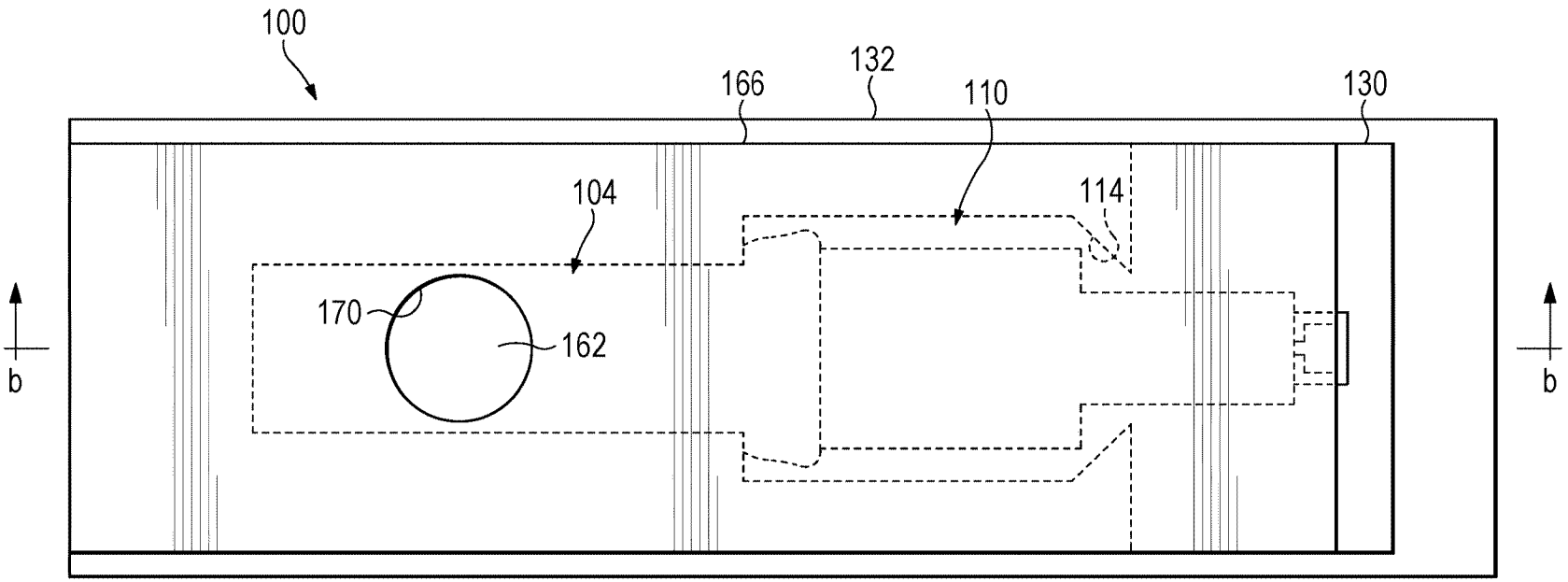
FIG. 14*a* is a top view of a portion of a printhead during fabrication of the printhead, according to the example fabrication method.
Figure 14B:
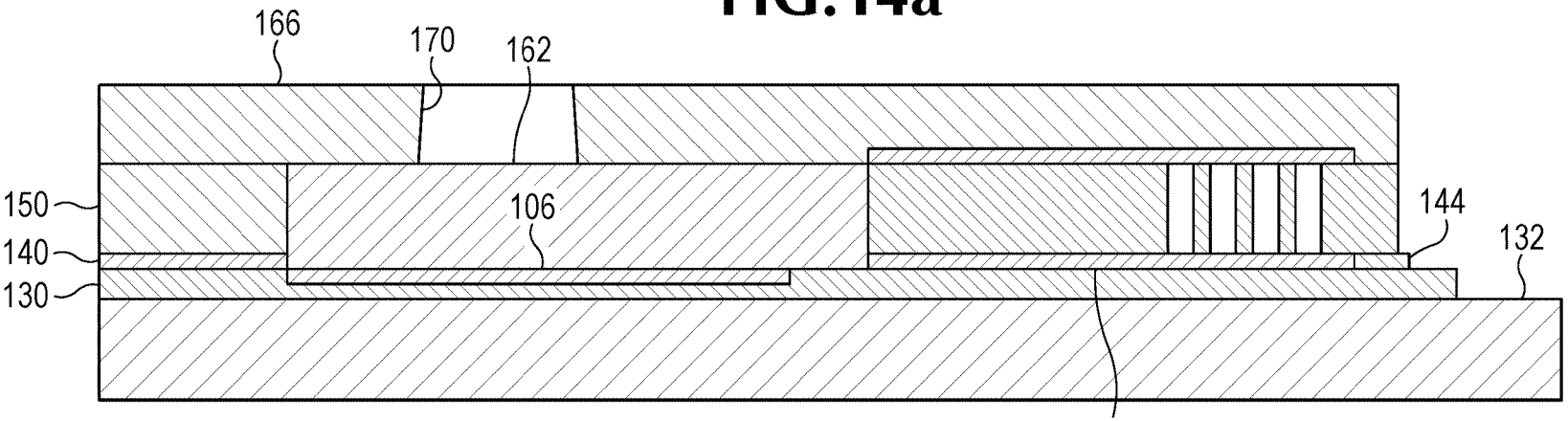
FIG. 14*b* is a cross-sectional view of the portion of the printhead of FIG. 14*a*.

The implementation of method 128 of FIG. 5 includes depositing wax 162 to fill the partially defined firing chamber 104 (block 164). FIG. 13a is a top view diagram depicting an example wax 162 deposited on printhead 100 and FIG. 13b is a cross-sectional view diagram of FIG. 13a along line b-b. Interior chambers or other cavities of printhead 100 can be filled with wax 162 so as to allow create a substantially flat surface to allow additional layers to be added on top of the wax. As shown by FIGS. 14a and 14b, in the example illustrated, wax 162 may extend into chamber 110, connecting check valve head portion 118 to those portions of the floor of chamber 110 and the floor of chamber 104 formed by film layer 130. Wax can be made of a material that can be easily removed during a wax recovery process so as to form a chamber structure once the wax is recovered. In some implementations the depositing wax 162 occurs prior to the depositing of a top release layer 158 which would result in wax 162 supporting the top release layer 158 in the formation of a spring.

The implementation of method 128 of FIG. 5 includes depositing a nozzle layer 166 over wall portion 150, top release layer 158, and wax 162 (block 168). FIG. 14*a* is a top view diagram depicting an example nozzle layer 166 including an opening in the form of a nozzle 170 deposited on printhead 100 and FIG. 14*b* is a cross-sectional view diagram of FIG. 14*a* along line b-b. Nozzle 170 can be designed to control a direction or characteristics of printer fluid flow as it exits printhead LOU. For example, nozzle 170 can be designed to control the rate of flow, speed, direction, mass, shape, and/or the pressure of the stream that emerges from them. As described in further detail below, in some implementations of printhead 100, printer media can, during printing, be moved under nozzle 170 of printhead 100. In some implementations, printhead 100 can be designed to print text, pictures, or other graphics onto printer media by propelling droplets of liquid printing fluid through nozzle 170 and onto printer media. In some implementations, nozzle 170 can be a separate piece removably attached to printhead 100 such that a single channel is formed through printhead 100 and nozzle 170. In some implementations, nozzle 170 is a single piece of material with printhead 100 and may alternatively be referred to as a nozzle portion of printhead 100. Nozzle 170 can be deposited on substrate 132 via a photolithographic technique or through another suitable fabrication technique.

Figure 15A:
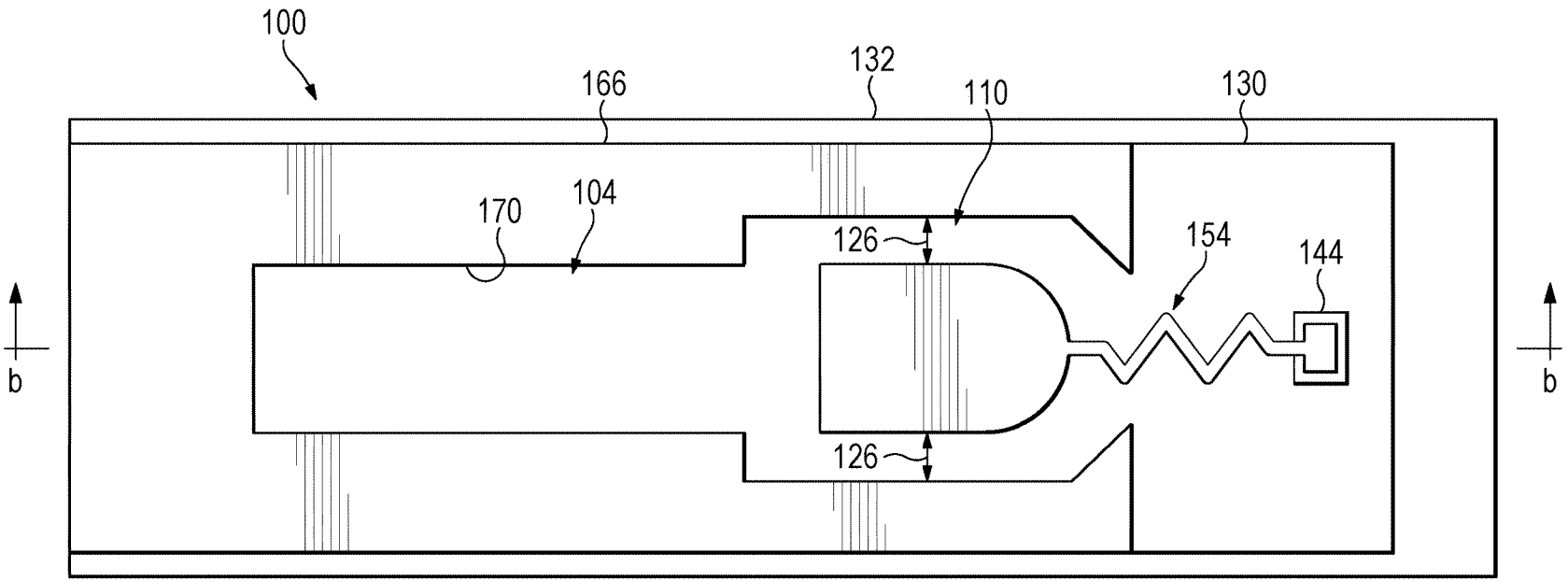
FIG. 15*a* is a top view of a portion of a printhead during fabrication of the printhead, according to the example fabrication method.
Figure 15B:
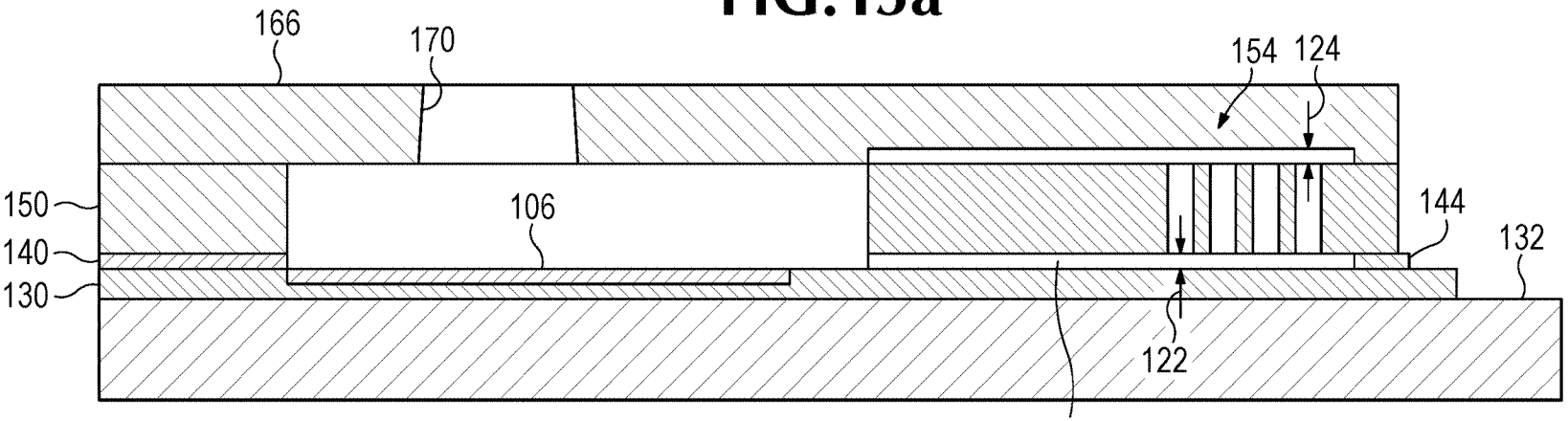
FIG. 15*b* is a cross-sectional view of the portion of the printhead of FIG. 15*a*.

In some implementations, method 128 can further include removing wax 162, bottom release layer 146, and top release layer 158. FIG. 15*a* is a top view diagram depicting printhead 100 with wax 162, bottom release layer 146, and top release layer 158 removed and FIG. 15*b* is a cross-sectional view diagram of FIG. 15*a* along line b-b. Nozzle layer 166 is omitted from FIG. 15*a* for clarity. As shown by FIG. 15*b*, removal of release layer 146 releases check valve head portion 118 and spring portion 120. Following such release, spring portion 120 has a first portion joined to check valve head portion 118, a second portion affixed to spring mount 144 by a third portion between the first portion of the second portion that is released from and movable with respect to the surface of the larger chamber formed by chambers 104 and 110. In some implementations, release layers are removed with a chemical etchant. In some implementations, release layers can, for example, be exposed to a pattern of light that causes a chemical change in the release material that allows the release to be removed by a developer solution. The release layers can, for example, be in the form of a positive photoresist, which becomes soluble in the developer solution when exposed or a negative photoresist, where unexposed regions are soluble in the developer solution. It is appreciated that one or more additional photolithographic or other fabrication steps can be used during fabrication of printhead 100 and that the above disclosure is not intended to be exhaustive of every step in a photolithographic process.

FIG. 16 illustrates an implementation of a printer 174 including a printhead 100 with a photolithographically fabricated check valve element 112 that is movable within a firing chamber of the printhead 100 to reduce printer fluid blowback caused by resistor 106 of printhead 100. For simplicity, printhead 100 of printer 174 uses the same reference numbers of various implementations of printheads described above. However it is appreciated that modifications to the printhead or alternative implementations of printhead 100 can be used. As described in further detail below, printer 174 includes a housing 176 that houses various internal parts of printer 174, a printing cavity 178 in which printhead 100 and other components are located, first, second, and third media trays 180, 182, and 184 for holding a printer media 186, buttons 188 to allow user input for printer 174, and a display screen 190 to display information regarding printer 174. It is appreciated that, in some implementations, printer 174 may include additional, fewer, or alternative components. As but one example, in some implementations, printer 174 may not include buttons 188 or display screen 190 and may instead be remotely controlled by an external computer or controller.

In use, printer media 186 is passed through a slot 192 of printer 174 and is then positioned under a printer cartridge 194. Cartridge 194 includes an array of printheads 100 for ejecting printer fluid onto printer media 186. Each printhead can, for example, be fluidly connected to respective printer fluid tanks to receive printer fluid from each tank. Cartridge 194 is designed for use with a fixed position print bar with a substrate-wide array of nozzles 170. In such implementations, printer media 186 can, during printing, be moved under nozzles 170 of cartridge 194. Cartridge 194 can be designed to print text, pictures, or other graphics 196 onto media 186 by propelling droplets of liquid printing fluid onto media 186. For example, when the printhead is located at the desired width and length location, the printhead can be instructed to propel one or more droplets of printing fluid onto the substrate in order to print graphic 196 onto the substrate. The printhead and/or the substrate can then be moved to another position and the printhead can be instructed to propel additional droplets of printing fluid onto the substrate in order to continue printing the graphic onto the substrate.

Housing 176 of printer 174 is designed to house various internal parts of printer 174, such as a feeder module to feed printer media through printer 174 along feed direction 198, a processor for controlling operation of printer 174, a power supply for printer 174, and other internal components of printer 174. In some implementations, housing 176 can be formed from a single piece of material, such as metal or plastic sheeting. In some implementations, housing 176 can be formed by securing multiple panels or other structures to each other. For example, in some implementations, housing 176 is formed by attaching separate front, rear, top, bottom, and side panels. Housing 176 can include various openings, such as openings to allow media trays 180, 182, and 184 to be inserted into housing 176, as well as vents 200 to allow airflow into the interior of printer 174.

Media trays 180, 182, and 184 can be used to store printer media, such as for example printer paper. Each media tray can, for example, be designed to hold the same or a different size media. For example, media tray 180 can be designed to hold standard letter-sized paper, media tray 182 can be designed to hold A4 paper, and media tray 184 can be designed to hold 11×17 paper. It is appreciated that printhead 100 can be used in printers with only a single media tray or, in some implementations, with no media trays.

Printer 174 can include one or more input devices to send operator inputs to printer 174. For example, as depicted in FIG. 16 such input devices can include buttons 188, which can, for example, be designed to allow an operator to cancel, resume, or scroll through print jobs. Buttons 188 can also be designed to allow an operator to view or modify printer settings. It is appreciated that in some implementations, printer 174 can be remotely controlled by a remote computer or operator and may not include buttons 188 or other user inputs.

Printer 174 can include one or more output devices to provide output information from printer 174 to an operator. For example, as depicted in FIG. 16, such an output device can be in the form of a display screen 190 connected to a processor to display information regarding printer 174, such as information regarding a current or queued print job, information regarding settings of printer 174, or other information. It is appreciated that printer 174 may include other types of output devices to convey information regarding printer 174, such as a speaker or other suitable output device.

In some implementations, display screen 190 and buttons 188 can be combined into a single input/output unit. For example, in some implementations, display screen 190 can be in the form of a single touchscreen that both accepts input and displays output. In some implementations, printer 174 does not include any input/output units and is instead connected to another device or devices for receiving input and sending output. For example, in some implementations, printer 174 can interface with a remote computer over the Internet or within an internal network. The remote computer can, for example, receive input from a keyboard or other suitable input device, and output information regarding printer 174 via a monitor or other suitable output device.

Printer 174 includes a reservoir 202 that is designed to store a supply of printer fluid for use in printer 174. Reservoir 202 can be in a form suitable for long-term storage, shipment, or other handling. Reservoir 202 can, for example, be a rigid container with a fixed volume (e.g., a rigid housing), a deformable container (e.g., a deformable bag), or any other suitable container for the printing fluid supply. Reservoir 202 can be stored within a housing of printer 174. For example, in some implementations, a cover or housing panel of a printer can be removed to allow a user to access and/or replace reservoir 202. In some implementations, reservoir 202 can be located outside of a housing of printer 174 and can, for example, be fluidly connected to printer 174 via an intake port on an exterior surface of a housing of printer 174.

Printer fluid can be flowed from printing fluid reservoir 202 to printhead 100 via a pump, plunger, or another suitable actuator. For example, in implementations where reservoir 202 is a flexible bag, an actuator can be used to compress reservoir 202 to force printer fluid out of reservoir 202 and into printhead 100 or an intermediary fluid path connecting reservoir 202 and printhead 100. In some implementations, reservoir 202 can be positioned above printhead 100 so as to allow a gravitational force to assist in providing printer fluid from reservoir 202 to printhead 100. Although reference is made herein to printer fluid being transferred from reservoir 202 to printhead 100, it is appreciated that in some implementations, printer 174 can be designed to flow printer fluid from printhead 100 to reservoir 202 for storage or another desired purpose.

While certain implementations have been shown and described above, various changes in form and details may be made. For example, some features that have been described in relation to one implementation and/or process can be related to other implementations. In other words, processes, features, components, and/or properties described in relation to one implementation can be useful in other implementations. Furthermore, it should be appreciated that the printheads or other systems and methods described herein can include various combinations and/or sub-combinations of the components and/or features of the different implementations described. Thus, features described with reference to one or more implementations can be combined with other implementations described herein. It is further appreciated that the choice of materials for the parts described herein can be informed by the requirements of mechanical properties, temperature sensitivity, moldability properties, or any other factor apparent to a person having ordinary skill in the art. For example, one more of the parts (or a portion of one of the parts) can be made from suitable plastics, metals, and/or other suitable materials.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A method for forming a check valve, the method comprising:

photolithographically forming a check valve head portion positioned in and connected to a chamber proximate a chamber opening valve seat; and releasing the check valve head portion from the chamber such that the check valve head portion is no longer immovable relative to the chamber so as to form a check valve head movable within the chamber towards and away from the chamber opening valve seat.

2. The method of claim 1, wherein photolithographically forming the check valve head portion comprises:

depositing a film layer on a substrate;

depositing a primer layer on the film;

depositing a bottom release layer on the film;

depositing a wall portion on the bottom release layer, wherein the wall portion is to partially define a chamber;

depositing the check valve head portion on the primer layer, wherein the check valve head portion is to define a check valve head that is closeable;

depositing a top release layer on the check valve head portion;

depositing wax to fill the partially defined chamber; and depositing a fluid discharge layer over the chamber, the top release layer, and the wax, the fluid discharge layer forming an opening extending from the chamber.

3. The method of claim 2, further comprising:

removing the wax, the bottom release layer, and the top release layer.

4. The method of claim 2, wherein depositing the wall portion and depositing the check valve head portion is performed in a single photolithographic operation.

5. The method of claim 2, wherein depositing the wall portion and depositing the check valve head portion includes depositing the portions to have the same height.

6. The method of claim 1, wherein a wax layer connects the check valve head portion and the chamber and wherein releasing the check valve head portion from the chamber comprises removing the wax layer.

7. The method of claim 1, wherein at least one release layer extends from the check valve head portion and wherein releasing the check valve head portion from the chamber comprises removing at least portions of the at least one release layer extending from the check valve head portion.

8. The method of claim 1, wherein the photolithographically forming of the check valve head portion in and connected to the chamber comprises depositing both the chamber and the check valve head portion in a single photolithographic operation.

9. The method of claim 1 further comprising forming a spring extending from the check valve head.

10. The method of claim 9, wherein forming the spring extending from the check valve head comprises:

photolithographically forming a spring portion on a support layer; and releasing the spring portion from the support layer to form the spring.

11. The method of claim 10, wherein the photolithographically forming of the spring portion on the support layer and the photolithographically forming of the check valve head portion comprise depositing a single layer that forms both the spring portion and the check valve head portion.

12. The method of claim 11, wherein the chamber is part of the check valve being formed and wherein the single layer is deposited upon a surface of the chamber.

13. The method of claim 10, wherein the chamber is part of the check valve being formed, wherein the spring portion is photolithographically formed on a surface of the chamber and is affixed to the surface of the chamber prior to the releasing.

14. The method of claim 13, wherein following the releasing, the spring portion has a first portion joined to the check valve head, a second portion affixed to the surface of the chamber and a third portion between the first portion and the second portion released from and movable with respect to the surface of the chamber.

15. The method of claim 1 further comprising surrounding the check valve head portion with at least one sacrificial material, wherein the releasing of the check valve head portion comprises removing the least one sacrificial material.

16. The method of claim 15, wherein the chamber is part of the check valve being formed and wherein the at least one sacrificial material extends between the check valve head portion and a surface of the chamber.

17. The method of claim 1 further comprising forming a resistor in the chamber.

18. The method of claim 1, wherein the check valve head is cylindrical and is slidable within the chamber.

19. The method of claim 1, wherein the chamber opening valve seat extends along a nozzle opening.

20. The method of claim 1, wherein the chamber as part of the check valve being formed, wherein the check valve head portion is photolithographically formed on a surface of the chamber and is affixed to the chamber prior to the releasing.

* * * * *